US006119054A

United States Patent [19]

Miki et al.

[11] Patent Number: 6,119,054

[45] Date of Patent: Sep. 12, 2000

[54] METHOD AND DEVICE FOR CONTROLLING A CONSTRUCTION MACHINE

[75] Inventors: Masatoshi Miki; Mitsuru Hikiyama, both of Kobe, Japan; Regis Ega, Tarcienne, Belgium

[73] Assignee: Shin Caterpillar Mitsubishi Ltd., Japan

[21] Appl. No.: 09/026,858

[22] Filed: Feb. 20, 1998

[30] Foreign Application Priority Data

Feb. 25, 1997 [JP] Japan ..... 9-040679

[51] Int. Cl.[7] ..... G05B 11/60

[52] U.S. Cl. ..... 700/275; 700/1; 701/50; 701/36; 172/2; 172/812

[58] Field of Search ..... 37/234, 348; 172/812, 172/2, 3; 701/36, 56, 53, 50; 700/275, 1, 56, 17

[56] References Cited

U.S. PATENT DOCUMENTS 4,013,875 3/1977 McGlynn ..... 701/50
5,557,510 9/1996 McIntryre et al. ..... 700/17
5,810,095 9/1998 Orbach et al. ..... 172/2
5,897,600 4/1999 Elmore et al. ..... 710/50
5,990,571 11/1999 Sato et al. ..... 307/10.1

*Primary Examiner*—William Grant
*Assistant Examiner*—Paul Rodriguez
*Attorney, Agent, or Firm*—Morrison Law Firm

[57] ABSTRACT

A signal sending device 21 which stores therein proper data, such as an accelerator position and a pump output, concerning operating conditions, such as supply hydraulic pressure and flow rate, appropriate for a working attachment to be attached to the front part of a hydraulic excavator or the like is mounted on the working attachment. The body of a hydraulic excavator is provided with a controller 11 adapted to control the hydraulic sources by receiving and storing proper data sent from the signal sending device 21. The signal sending device 21 includes a ROM 31 for storing proper data for each working attachment, a CPU 32 for retrieving proper data from the ROM 31, and a data communication interface (COM) 33 for receiving command signals sent from the controller 11 of a machine body to the CPU 32 and sending to the controller 11 proper data which have been retrieved from ROM 31 by the CPU 32.

4 Claims, 7 Drawing Sheets

METHOD AND DEVICE FOR CONTROLLING A CONSTRUCTION MACHINE

BACKGROUND OF THE INVENTION

The present invention relates to a control method for a construction machine, such as a hydraulic excavator, a backhoe or a loader, and a control device used for said method. More particularly, the invention concerns a control method and a control device which enable an operator who is replacing a front attachment, such as a bucket, that is mounted on the front part of a hydraulic excavator or the like with another attachment, such as a hammer, to set such conditions as hydraulic pressure to be supplied, flow rate and so forth with a single action according to the specific requirements of the selected attachment.

As shown in FIG. 6, a hydraulic excavator typically includes a machine body 1 which comprises a lower structure 1*a*, an upper structure 1*b*, a cab 1*c*, a boom 1*d* of the front working part and an arm 1*e* and is adapted to permit a bucket attached to the front part of the shovel to be easily replaced by a different working attachment 2 (for example, a hammer) so that the excavator may be used for various kinds of operation.

As these working attachments 2 are all hydraulic actuators in one way or another and require their own respective working conditions, i.e. rated supply pressures and flow rates of working fluid, it is necessary to set different control criteria for each attachment at hydraulic sources of the main body 1 of the construction machine. For example, even in case of working attachments 2 of the identical type, rated supply pressure and flow rate differ depending on the manufacturer and the capacity of the attachment, and the optimum working conditions for each attachment differ accordingly.

FIG. 7 shows a conventional control device for a hydraulic excavator, which includes hydraulic pumps 4,5 adapted to feed working fluid through a control valve 3 to a working attachment 2 removably attached to the machine body 1. Discharge flow rates of the hydraulic pumps 4,5 are controlled based on engine speed and preset pump outputs, said engine speed adjusted by an accelerator actuator 7 of a diesel engine 6 in accordance with the position of the accelerator, and the preset pump outputs adjusted by pump regulators 8,9.

A flow control valve 10 is disposed at the downstream side of a center bypass line of the control valve 3, with the pressure signal line at its upstream side connected to the pump regulators 8,9. With the configuration as above, the control valve 10 is adapted to conduct what is generally called negative flow rate control, wherein pump flow rate is low when the pressure is high, while pump flow rate is high when the pressure is low. The connection at this part is omitted in FIG. 7.

The accelerator actuator 7 and the pump regulators 8,9 perform the control function in accordance with signals output from a controller 11 which is a part of the machine body 1. The pump regulators 8,9 perform control by way of transforming current to hydraulic pressures by using proportional control solenoid valves 12,13.

As shown in FIG. 7, a typical conventional control method calls for connecting resisters 14*a*, 14*b* to a battery 15, the resisters 14*a*, 14*b* being capable of coping with various rated pressures and flow rates of working attachments 2.

Then, through a manually operated selector switch 16, electrical signals (electric current in this case) is input into the proportional control solenoid valves 12,13, which transform the current into hydraulic pressures, and the hydraulic pressures are then respectively input into the pump regulators 8,9 adapted to set the outputs of the pumps. Receiving the discharge pressure from the pumps, the pump regulators 8,9 so control the power fed from the engine 6 to the hydraulic pumps 4,5 as to be maintained at a constant level. Thus, the working fluid discharged by the hydraulic pumps 4,5 enables any working attachment 2 mounted on the machine body 1 to function in the rated operating condition.

A conventional control method calls for an operator of a machine such as a hydraulic excavator to adjust the revolution speed of the engine 6 by means of manual operation of an accelerator dial 17. In other words, while signals from the accelerator dial 17 are input to the controller 11 the revolution speed of the engine 6 is detected by a sensor 18 so that signals representing the detected speed are also input to the controller 11.

At that stage, upon comparison of the engine speed set by the accelerator dial 17 with the actual engine speed input from the sensor 18,the controller 11 computes values for driving the accelerator actuator 7 in order to make the actual engine speed consistent with the set speed and outputs the signals that represent the computed values to the accelerator actuator 7.

When the accelerator is operated at its maximum capacity, with the engine speed at the rated value or more, the controller 11 outputs signals to increase the pump outputs so that hydraulic pressure signals which have been transformed at the proportional control solenoid valves 12,13 are input into the pump regulators 8,9. On the other hand, when the engine speed becomes lower than the rated value, the controller outputs signals that will reduce the pump outputs, thereby controlling the outputs of the hydraulic pumps 4,5 not to exceed the engine output.

In addition to a control valve 3 for controlling actions of a working attachment 2, a control valve 3*a* for controlling actions of another hydraulic actuator, such as a boom cylinder 2*a* or the like, is disposed on the discharge line of the hydraulic pumps 4,5. These control valves 3,3*a* are pilot-operated by means of, for example, a pedal-type operating device 19 and a lever-type operating device 19*a* respectively.

SUMMARY OF THE INVENTION

As described as above, when a working attachment attached to the machine body 1 is put into operation, the conventional control circuit shown in FIG. 7 controls actions of the working attachment 2 through pilot operation of the control valve 3 by means of, for example, the pedal-type operating device 19. Prior to this operation, however, an inconvenient operation is required: the manual selector switch 16 has to be operated beforehand in order to select the line that includes the resisters 14*a*, 14*b*, where the required hydraulic pressure and flow rate can be provided.

Furthermore, the above circuit can cope with only a single working attachment 2. When changing a working attachment 2 for another attachment made by a different manufacturer, it is necessary to change the resisters 14*a*, 14*b* as well, because of different rated pressures and flow rates. Such a changing operation is very complicated and troublesome. When replacing a working attachment 2 with a different kind of attachment, too, the same procedure is required.

Although this problem may be solved by providing a necessary number of resisters 14*a*, 14*b* and selector switches 16, complicated and troublesome task of changing resisters 14*a*, 14*b* and operating switches 16 is still necessary. Also, there arises the danger of making mistakes in changing the resisters or operating the switches.

According to the method described above, whenever changing working attachments 2, the revolution speed of the engine 6 has to be set at the appropriate value for the just attached working attachment 2 by manually adjusting the accelerator dial 17. This adjustment is also troublesome.

In short, the conventional control method described above presents a problem in that operation required to appropriately adjust the hydraulic source, which is constituted by the hydraulic pumps 4,5 and the pump driving engine 6, according to each respective working attachment is difficult and troublesome.

In order to solve the above problems, an object of the present invention is to provide a method and a device for controlling a construction machine, wherein the hydraulic sources automatically function in the appropriate conditions for the working attachment which is currently being operated.

The invention relates to a control method for a construction machine, said control method calling for storing proper data in a working attachment which may be removably attached to the machine body, sending proper data stored in the working attachment to the machine body, and, based on said proper data, controlling the hydraulic sources which are adapted to feed working fluid from the machine body to the working attachment.

According to the above method, proper data stored in each respective working attachment are sent to the machine body in compliance with command signals from the machine body requiring transmittance of the data, and hydraulic sources provided at the machine body, such as the pumps and the pump drive engine, are automatically controlled according to the proper data.

The invention also relates to a construction machine control device adapted to control working fluid fed to a working attachment attached to the machine body by controlling hydraulic sources provided at the machine body, said control device including a signal sending device attached to a working attachment and adapted to store proper data necessary for setting operating conditions required by the working attachment and send signals representing said proper data, and a controller provided at the machine body and adapted to receive and store proper data sent from the signal sending device and control the hydraulic sources.

With the configuration as above, a signal sending device for storing proper data is mounted on each working attachment beforehand, and, when a working attachment is attached to the machine body, the proper data is sent from the signal sending device through wire or radio wave to the controller and stored therein, said controller adapted to control hydraulic sources in the machine body, such as pumps and a pump driving engine, so that the optimal hydraulic pressure, flow rate and any other conditions required are automatically provided.

In accordance with the invention, the signal sending device of a construction machine control device noted above includes a data storage device for storing proper data for each respective working attachment, a central processing device for retrieving proper data from the data storage device, and a transmitting means adapted to receive retrieval command signals sent from the controller of the machine body to the central processing device and send to the controller proper data which have been retrieved from the data storage device by the central processing device.

With the last-mentioned configuration, the central processing device retrieves proper data concerning the working attachment from the data storage device in compliance with retrieval command signals transmitted from the controller and sends the proper data to the controller in the machine body through a transmitting means, i. e. wire or radio wave.

Further according to the invention, the above-mentioned signal sending device includes a data storage device for storing proper data for each respective working attachment, and a transmitting means adapted to receive clock pulse signals from the controller of the machine body and send proper data in the data storage device to the controller. With this configuration, every time the signal sending device receives a clock pulse signal from the controller of the machine body, the signal sending device sends proper data in the data storage device to the controller through the transmitting means.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 4:
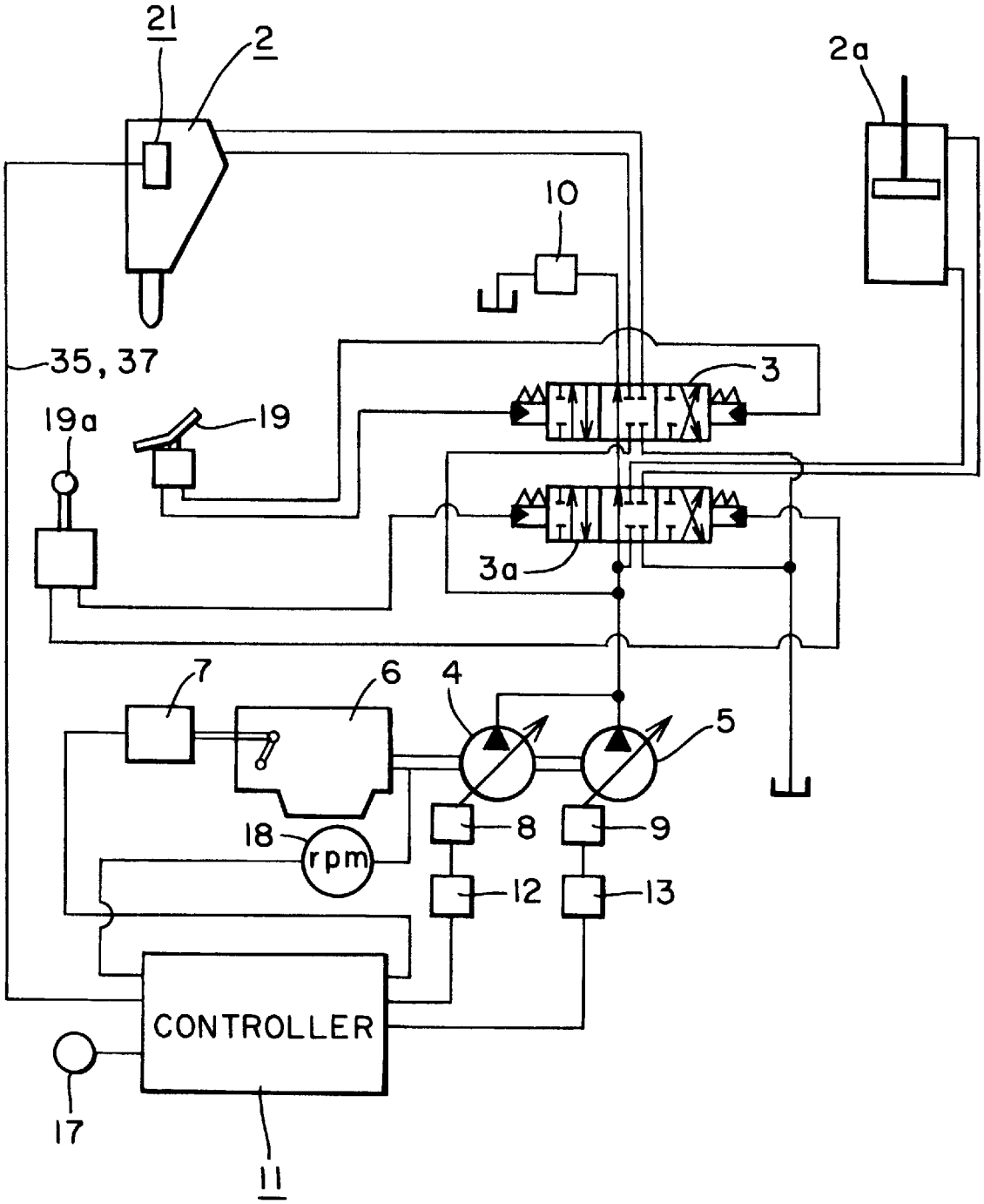
FIG. 4 is a circuit diagram of said control device according to any embodiment mentioned above.
Figure 5:
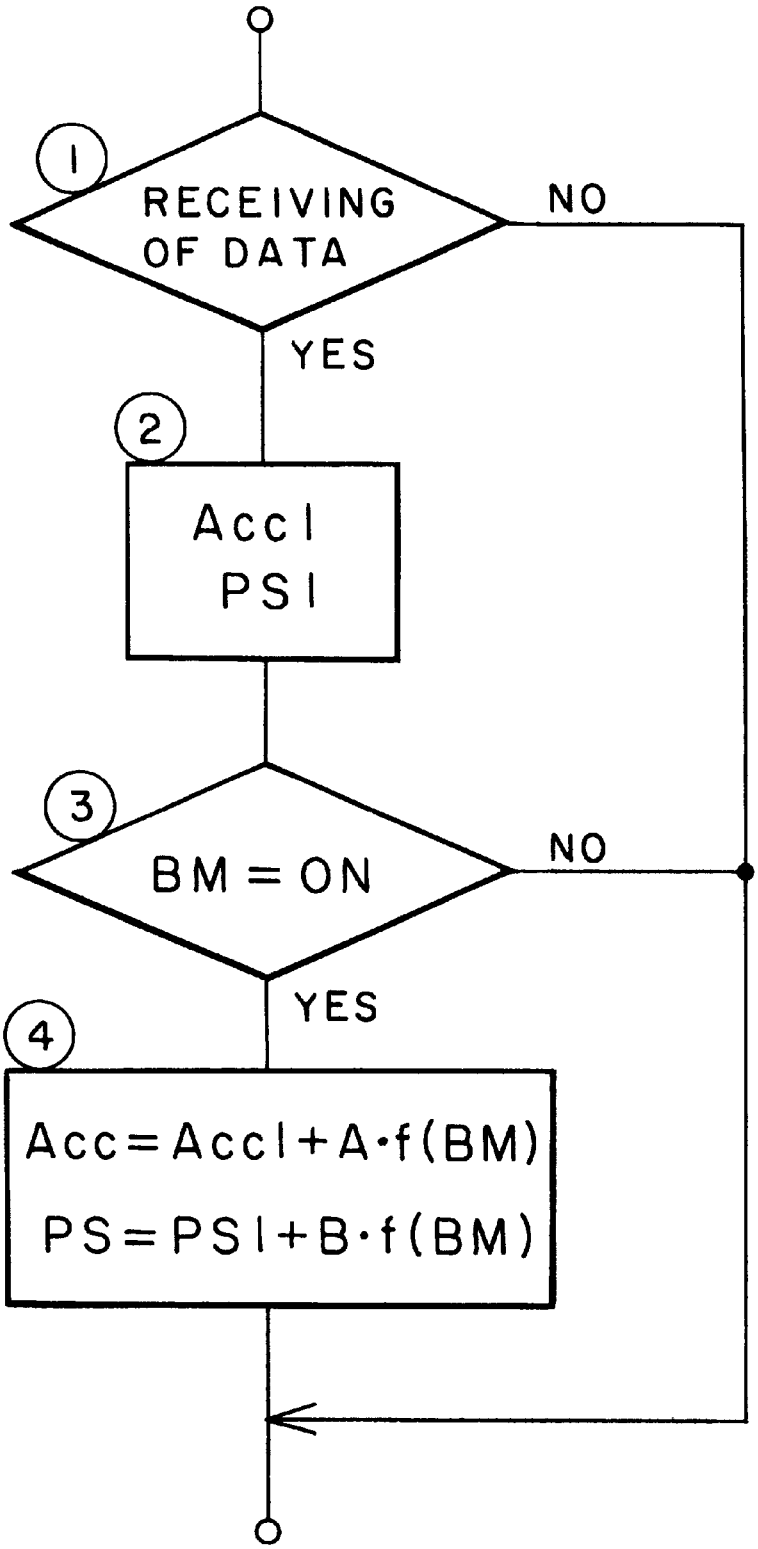
FIG. 5 is a flow chart showing a program for said control device to compute a position of the accelerator and pump output based on proper data.
Figure 6:
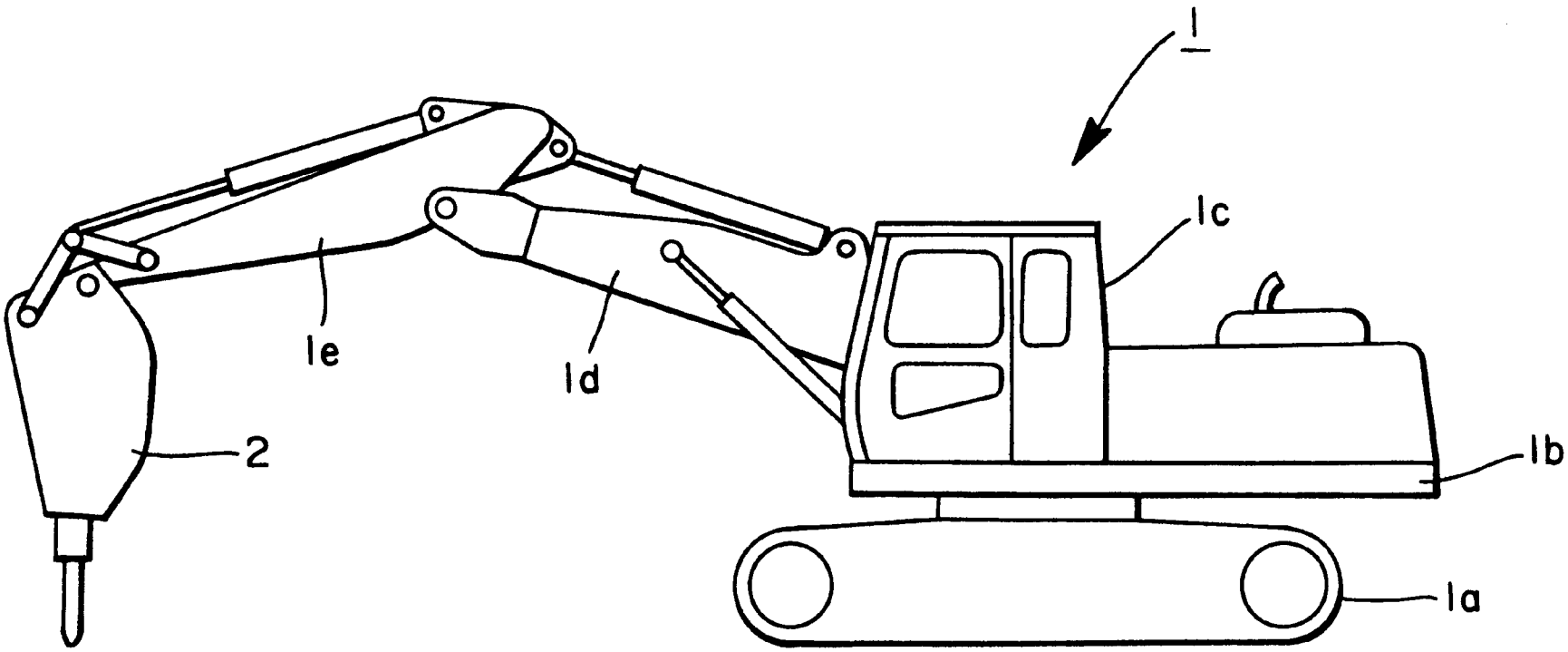
FIG. 6 is a side view of a construction machine wherein a hammer as a working attachment is attached to the body of a hydraulic excavator.
Figure 7:
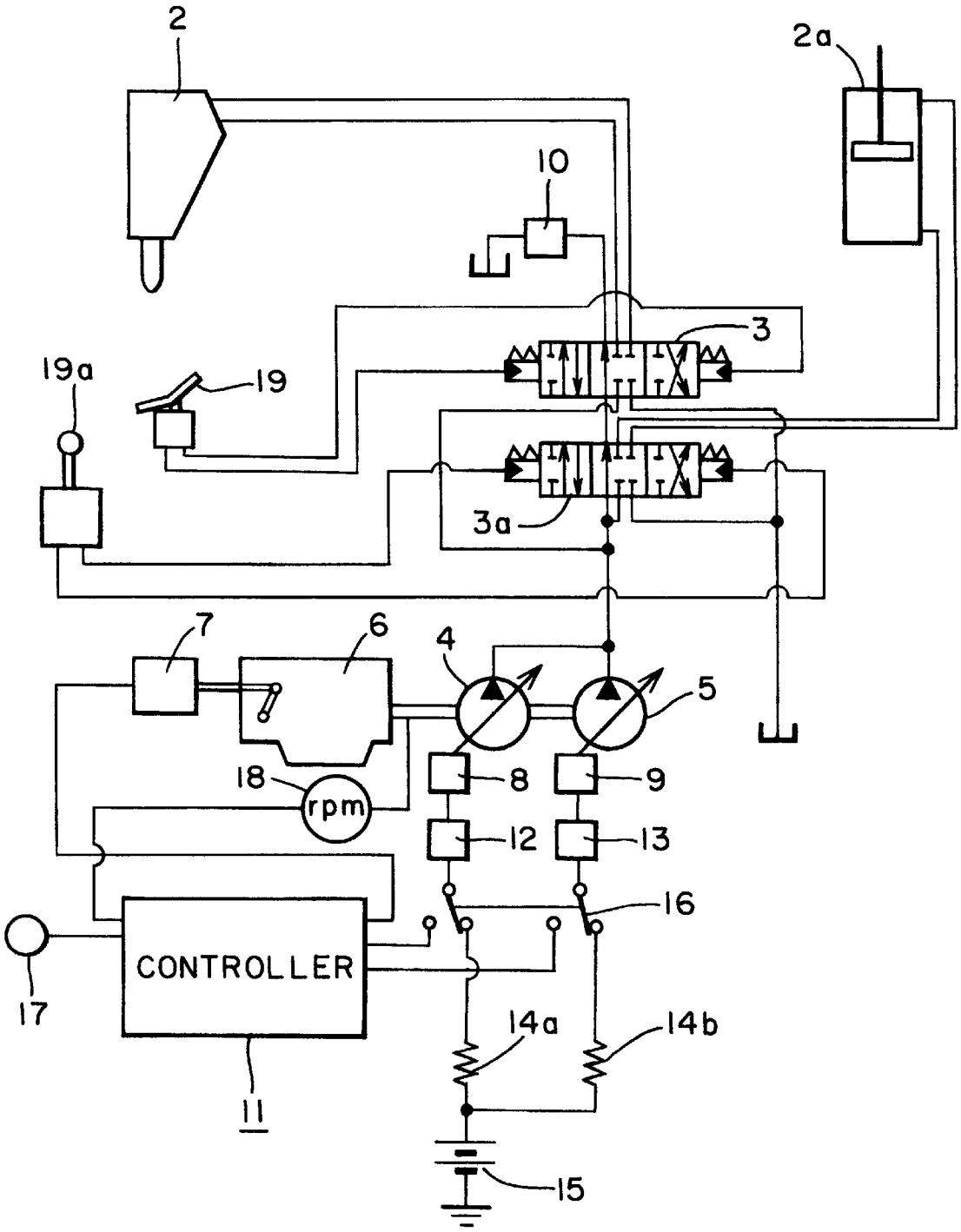
FIG. 7 Prior Art
FIG. 7 is a circuit diagram of a conventional control device for a construction machine.

Next, the invention is explained hereunder, referring to embodiments thereof shown in FIGS. 1 to 5, in which explanation of the elements similar to those shown in FIGS. 6 and 7, which are identified with the same reference numerals, may be omitted.

As shown in FIG. 4, components connected to the input side of a controller 11 of the body 1 of a hydraulic excavator include an accelerator dial 17 to be used when setting the revolution speed (rpm) of an engine 6 by hand, an engine speed sensor 18 for detecting the revolution speed of the engine 6, and a signal sending device 21 attached to a working attachment, such as a hammer 2 beforehand.

The signal sending device 21 is connected to the controller 11 through cables and connectors which will be described later, the connecting operation conducted being when the working attachment 2 is attached to the machine body 1.

Data for driving hydraulic sources, such as hydraulic pressure to be supplied and flow rate, has to be set in the controller 11 in order to satisfy necessary operation conditions characteristic to the working attachment 2 in which the signal sending device 21 is incorporated is stored in the signal sending device 21 beforehand. Such data is hereinafter referred to as proper data.

The controller 11 receives and stores therein proper data from the signal sending device 21 and controls the hydraulic sources accordingly. The hydraulic sources consist of hydraulic pumps 4,5, an engine 6 for driving these pumps, an accelerator actuator 7, pump regulators 8,9 and proportional control solenoid valves 12, 13.

The accelerator position, i. e. the position of the accelerator actuator 7 for controlling the engine speed of the engine 6 that drives the hydraulic pumps 4,5, preset pump output controlled by the pump regulators 8,9, increase coefficients and the like may be set as proper data in the controller 11.

Examples of the increase coefficients referred to in the above paragraph include an accelerator position correction coefficient and a pump output correction coefficient, which are respectively represented by A and B in Step 4 in FIG. 5.

FIG. 5 is a flow chart showing two cases: one where the controller 11 operates the working attachment 2 alone by using a signal representing proper data (an accelerator position ACC1 or a pump output PS1) without correcting the values which have been sent from the signal sending device 21, and the other where the controller 11 computes the accelerator position ACC or the pump output PS when simultaneously operating another hydraulic actuator, for example a boom cylinder 2*a*, with the working attachment (the hammer) 2 in order to, for example, push the blade of the hammer 2 against an object.

In case of a simultaneous operation as above, the controller 11 computes a compensation value A*f (BM) or B*f (BM) by multiplying a function (BM) regarding the degree of operation of a lever operator 19*a* in such a direction as to lower the boom, said lever operator 19*a* adapted to pilot-operate a control valve 3*a* of a boom cylinder 2*a*, by the constant accelerator position correction coefficient A or the pump output correction coefficient B. and then adds respectively the compensation value:

$$A*f(BM) \text{ or } B*f(BM)$$

to the accelerator position ACC1 or the pump output PS1, which are, as described above, used as they are in case of operating the working attachment 2 alone. The controller 11 then outputs the value obtained through the above computation, which serves as an adjusted value ACC or PS.

Next, the method of computing operation by the controller 11 shown in FIG. 5 is explained, also referring to FIG. 4. In FIG. 5, numerals enclosed with circles represent step numbers.

When the controller 11 has received signals representing proper data, such as an accelerator position ACC1 and a pump output PS1, from the signal sending device 21 (YES in Step 1), the controller 11 stores the proper data (Step 2) and, in cases where the boom cylinder 2*a* is at a standstill (NO in Step 3), the accelerator position ACC1 and the pump output PS1 are output from the controller 11.

The above procedure is further explained hereunder referring to FIG. 4. The working attachment 2 is operated by means of a pedal type operating device 19. To be more precise, by depressing the pedal type operating device 19, hydraulic pilot pressure corresponding to the degree of the depression is output and operates the control valve 3 that is connected through a pilot pressure output circuit to the pedal type operating device 19. As a result, the amount of pressure fluid fed from the hydraulic pumps 4,5 to the working attachment 2 is controlled in accordance with the degree of operation.

At that time, signals indicating that the operating device has been operated are detected from the pilot pressure output circuit of the pedal type operating device 19 by pressure switches (not shown) and input to the controller 11.

Upon receiving these signals, the controller 11 determines that the pedal type operating device 19 has been operated and outputs the accelerator position ACC1 and the pump output PS1 stored in the controller.

The signals representing the accelerator position, which have been output from the controller 11 are input into the accelerator actuator 7 and control the position of the accelerator of the engine 6. The pump output signals are input into the proportional control solenoid valves 12,13, where they are transformed into hydraulic pressures, and respectively input into the pump regulators 8,9 to control outputs of the hydraulic pumps 4,5.

Next, the procedure for operating another actuator (a boom cylinder 2*a* in this embodiment) simultaneously with the working attachment 2 described above is explained.

When using a working attachment 2, it is more effective to lower the boom Id (FIG. 6) to press the working attachment (the hammer) 2 against the object which is being broken. Therefore, this type of operation is often required. In this case, electrical signals from a pressure sensor (not shown) which is provided in the pilot pressure output circuit at the boom-lowering side of a lever type operating device 19*a*, which is adapted to drive the boom cylinder 2*a*, are input into the controller 11.

As the pilot pressure output circuit of the lever type operating device 19*a* is connected to a control valve 3*a*, the lever type operating device 19*a* operates the control valve 3*a* so that the amount of pressure fluid fed from the hydraulic pumps 4,5 to the boom cylinder 2*a* is controlled in accordance with the degree of operation.

When the boom cylinder 2*a* is contracted, in other words when the boom Id is lowered, the pump discharge rate is so increased as to make the driving speed for the boom cylinder 2*a* to conform with the command represented by the signals from the pressure sensor.

In other words, as shown in FIG. 5, when the boom cylinder 2*a* is operated simultaneously with operation of the working attachment 2 (YES in Step 3), the accelerator position ACC1 is corrected by adding the distance by which the accelerator position is extended, i. e. A*f (BM), to the accelerator position ACC1 stored in Step 2. At the same time, the pump output PS, too, is corrected by adding the amount of increase of the pump output, i. e. B*f (BM), to the pump output PS1 stored in Step 2. Thus, Step 4 is completed. Further, A and B are increase coefficients explained above, and f(BM) represents the function of a degree by which the lever type operating device 19*a* is operated.

As the pump discharge rate can be increased by outputting from the controller 11 adjusted values (ACC,PS) which have been computed as above, the control circuit according to the invention is capable of coping with simultaneous operation of the working attachment 2 and the boom cylinder 2*a*.

Figure 1:
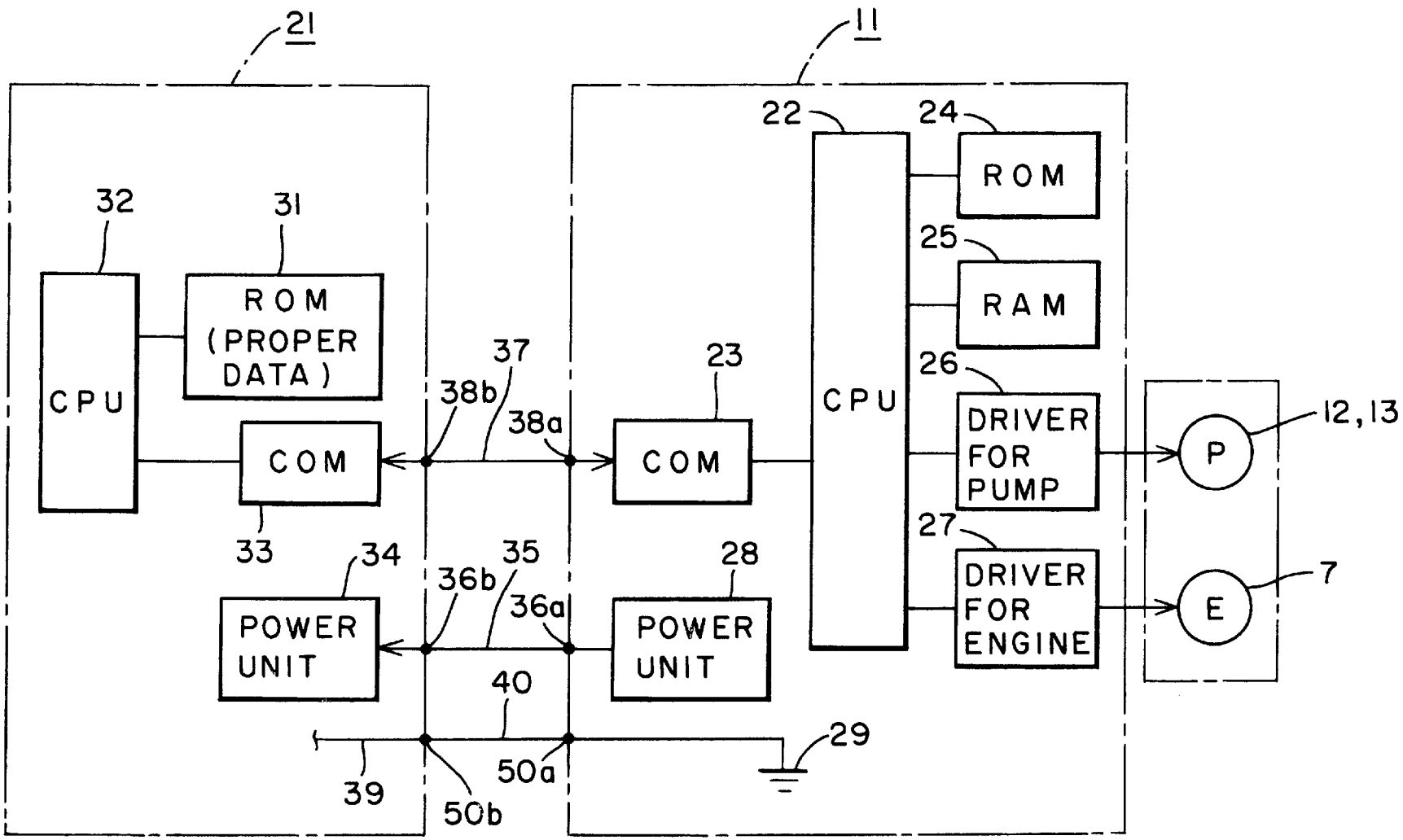
FIG. 1 is a block diagram of a control device for a construction machine according to an embodiment of the present invention.

FIG. 1 shows an example of the controller 11 and the signal sending device 21, wherein the controller 11 provided at the machine body includes a central processing device (hereinafter referred to as CPU 22) and members connected to the CPU 22, viz. a data communication interface (hereinafter referred to as COM 23) serving as a transmitting means to perform serial communication with the signal sending device 21 provided at the working attachment, a read-only memory (hereinafter referred to as ROM 24) which stores a control program therein, a random-access memory (hereinafter referred to as RAM 25) adapted to store therein proper data sent from the signal sending device 21, a driver 26 adapted to control preset pump output by driving the pump regulators 8,9 as hydraulic sources through the proportional control solenoid valves 12,13, and a driver 27 adapted to control the number of revolutions of the engine 6 by driving the accelerator actuator 7 as a hydraulic source. The controller 11 is also provided with an electric power supply unit (hereinafter referred to as the power unit 28) for operating the controller 11 and a ground earth 29 for grounding.

The signal sending device 21 includes a read-only memory (hereinafter referred to as ROM 31) which serves as a data storage device to store proper data concerning respective working attachments 2, a central processing device (hereinafter referred to as CPU 32) adapted to perform retrieval and processing of proper data received from the ROM 31, a data communication interface (hereinafter referred to as COM 33) serving as a transmitting means to receive through wire retrieval command signals from the controller 11 of the machine body to the CPU 32 and send through wire to the controller 11 the proper data which the CPU 32 has retrieved from the ROM 31, and an electric power supply unit (hereinafter referred to as the power unit 34) to which electric power is fed from the power unit 28 of the controller 11.

With the configuration as above, when the working attachment 2 is attached to the machine body 1, the power units 28,34 respectively included in the controller 11 of the machine body and the signal sending device 21 of the working attachment are connected to each other, and the COM 23 of the controller 11 and the COM 33 of the signal sending device 21 are connected to each other. Both connections are done through a wire connecting means; the power units 28,34 are connected through a power supply cable 35 and connectors 36*a*,36*b*, and the COMs 23,33 are connected through a communication cable 37 and connectors 38*a*,38*b*. At the same time, the ground earth 29 of the controller 11 and an earth line 39 of the signal sending device 21 are connected to each other through a grounding cable 40 and connectors 50*a*,50*b*.

Figure 2:
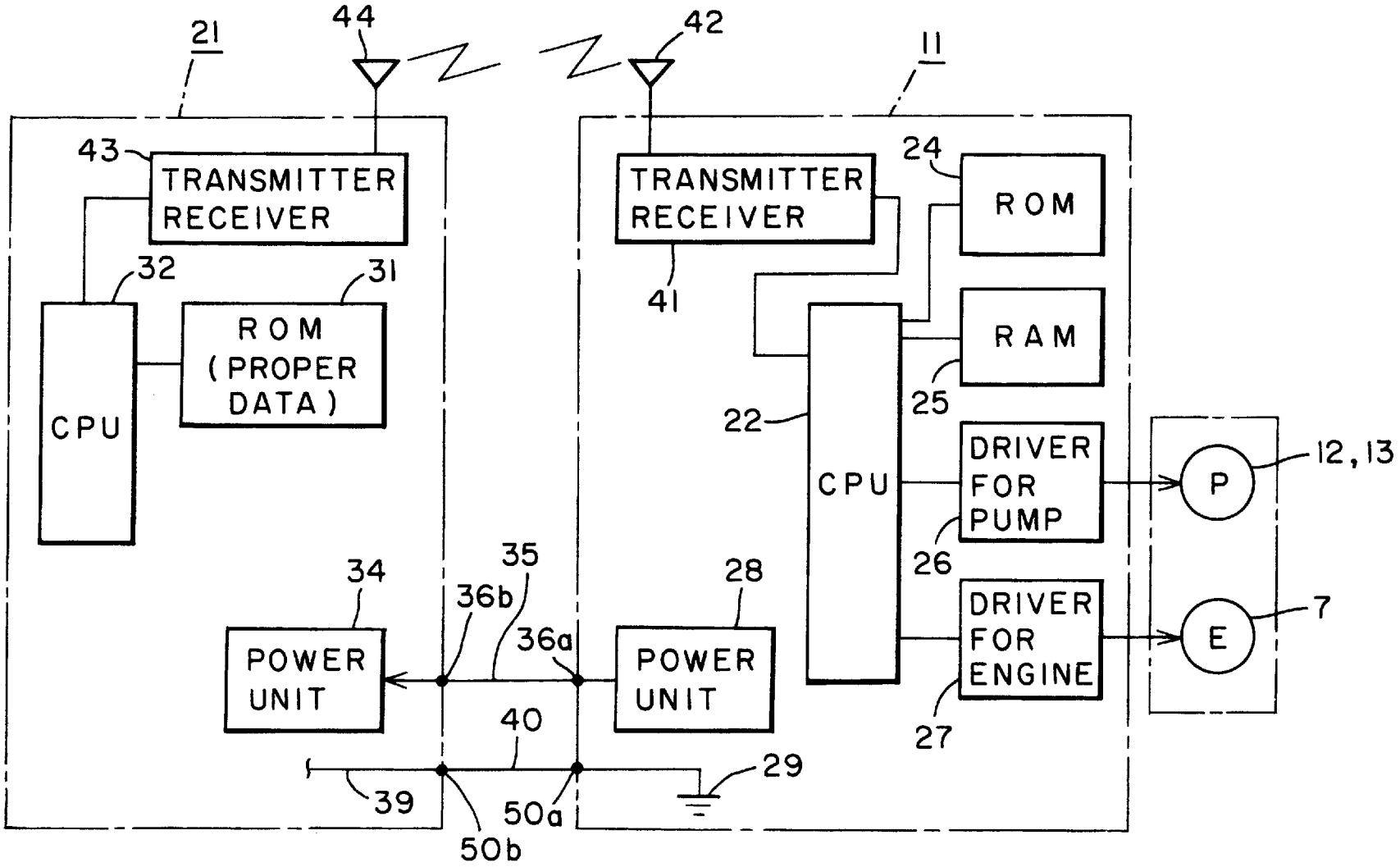
FIG. 2 is a block diagram of a control device for a construction machine according to another embodiment of the present invention.

Next, FIG. 2 shows another embodiment of the controller 11 and the signal sending device 21, wherein the controller 11 of the machine body includes a CPU 22 and members connected to the CPU 22, viz. a transmitting means or transceiver which consists of a radio transmitter-receiver (hereinafter referred to as the transmitter-receiver 41) and a transmit-receive antenna 42 and performs data communication by way of radio wave with the signal sending device 21 provided at the working attachment, a ROM 24 described above, a RAM 25 described above, a pump driver 26 described above, and an engine driver 27 described above. The controller 11 is also provided with a power unit 28 described above and a ground earth 29.

The signal sending device 21 includes a ROM 31 which has the same configuration as that of the first embodiment and serves as a data storage device to store proper data concerning respective working attachments 2, a CPU 32 which has the same configuration as that of the first embodiment and is adapted to retrieve proper data from the ROM 31, and a transmitting means adapted to receive by radio wave retrieval command signals sent from the controller 11 of the machine body to the CPU 32 and send by radio wave to the controller 11 the proper data which the CPU 32 has retrieved from the ROM 31, said transmitting means consisting of a radio transmitter-receiver (hereinafter referred to as the transmitter-receiver 43) and a transmit-receive antenna 44. The signal sending device 21 is also provided with a power unit 34 having the same configuration as that of the first embodiment, to which electric power is fed from the power unit 28 of the controller 11.

With the configuration as above, when the working attachment 2 is attached to the machine body 1, the power units 28,34 respectively included in the controller 11 of the machine body and the signal sending device 21 of the working attachment are connected to each other through a power supply cable 35 and connectors 36*a*,36*b*, and the ground earth 29 of the controller 11 and an earth line 39 of the signal sending device 21 are connected to each other through a grounding cable 40 and connectors 50*a*,50*b*. At the same time, data retrieval command signals from the controller 11 to the signal sending device 21 and signals representing proper data from the signal sending device 21 to the controller 11 are communicated between the transmitter-receiver 41 of the controller 11 and the transmitter-receiver 43 of the signal sending device 21.

Figure 3:
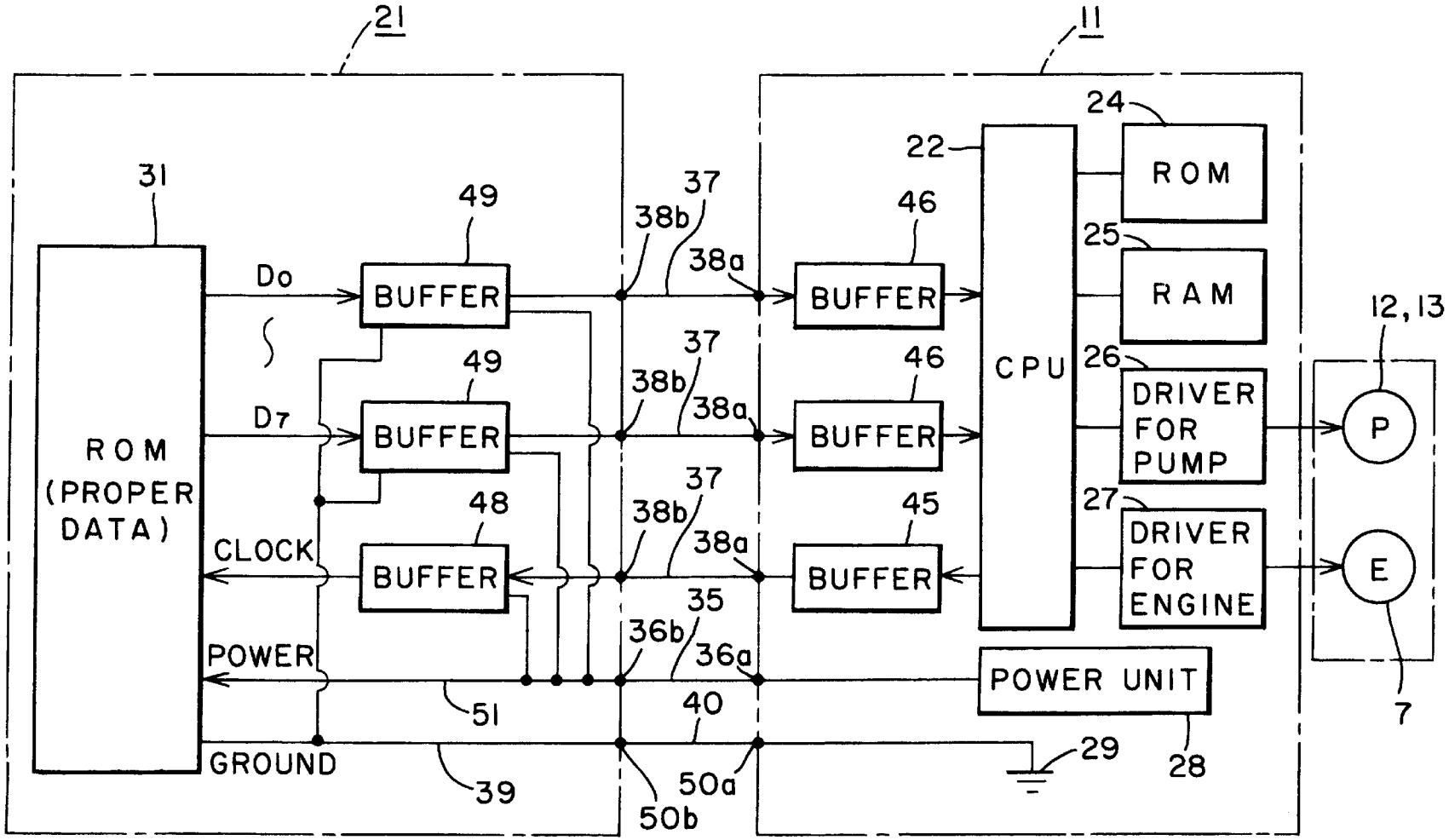
FIG. 3 is a block diagram of a control device for a construction machine according to yet another embodiment of the present invention.

Next, FIG. 3 shows yet another embodiment of the controller 11 and the signal sending device 21, wherein the controller 11 of the machine body includes a CPU 22 and members connected to the CPU 22, viz. a buffer 45 serving as a transmitting means to send clock pulse signals to the signal sending device 21 of the working attachment, a buffer 46 serving as a transmitting means to receive proper data sent from the signal sending device 21, a ROM 24 adapted to store a control program therein, a RAM 25 adapted to store therein proper data sent from the signal sending device 21, a driver 26 adapted to control preset pump output, and a driver 27 adapted to control the number of revolutions of the engine. The controller 11 is also provided with a power unit 28 for feeding electric power to the above members as well as the components of the signal sending device 21, and a ground earth 29 for grounding.

The signal sending device 21 includes a ROM 31 serving as a data storage device to store proper data concerning respective working attachments 2, a buffer 48 serving as a transmitting means to receive clock pulse signals sent from the controller 21 of the machine body, and a buffer 49 serving as a transmitting means to send proper data in the ROM 31 to the controller 11.

Although only two circuits for transmitting proper data are shown in FIG. 3, that is for the purpose of simplification of a drawing; it is needless to say that a necessary number of circuits may be provided in accordance with amount of data.

With the configuration as above, when the working attachment 2 is attached to the machine body 1, the buffers 45,46 of the controller 11 of the machine body are connected to the buffers 48,49 of the signal sending device 21 of the working attachment through a communication cable 37 and connectors 38*a*,38*b*, while the power unit 28 of the controller 11 is connected, through a power supply cable 35 and connectors 36*a*,36*b*, to a power supply line 51 adapted to feed electric power to the ROM 31 and the buffers 48,49 of the signal sending device 21. At the same time, the ground earth 29 of the controller 11 and an earth line 39 of the signal sending device 21 are connected to each other through a grounding cable 40 and connectors 50*a*,50*b*.

Next, the functions of the above embodiments shown in FIGS. 1 to 3 are explained hereunder.

All the proper data, such as an accelerator position and a preset pump output, which have to be input into the controller 11 of the machine body 1 in order to satisfy operation conditions, such as supply hydraulic pressure and flow rate, required to appropriately operate the working attachment 2 are stored in the ROM 31 of the signal sending device 21, and the signal sending device 21 is mounted on the working attachment 2 beforehand.

As proper data stored in the ROM 31, the position of the accelerator of the engine 6 may be set as, for example, the engine speed=1600 rpm, while a preset pump output may be set as the pump torque=60%.

According to the embodiment shown in FIG. 1, respective connections of the power supply cable 35 and the communication cable 37 are done when the working attachment 2 is attached to the machine body 1. When power is supplied to the signal sending device 21 of the working attachment 2 under this condition, the signal sending device 21 is actuated.

Then, through a programmed processing which calls for the CPU 22 to execute serial processing of commands in the ROM 24, the controller 11 outputs from the COM 23 data retrieval commands from the signal sending device 21.

Meanwhile, the signal sending device 21 reads the commands by means of the COM 33 and sends them to the CPU 32, and, through a programmed processing by the CPU 32, serially retrieves data (proper data concerning the working attachment 2) stored in the ROM 31 and transmits the retrieved data to the COM 23 of the controller 11 where the data is stored in the RAM 25 of the controller 11 by means of a programmed processing by the CPU 22.

At that time, according to the configuration of the embodiment shown in FIG. 1, two-way serial communication is conducted by means of a single communication cable 37. In other words, the data retrieval command is transmitted through wire from the controller 11 to the signal sending device 21, and the proper data is also transmitted through wire from the signal sending device 21 to the controller 11.

According to the configuration of the embodiment shown in FIG. 2, however, transmittance of the data retrieval command from the controller 11 to the signal sending device 21 and the proper data from the signal sending device 21 to the controller 11 is conducted by 2-way radio wave between the transmitter-receiver 41 of the controller 11 of the machine body and the transmitter-receiver 43 of the signal sending device 21 of the attachment.

According to the configuration of the embodiment shown in FIG. 3, every time a clock pulse signal is sent from the buffer 45 of the controller 11 to the buffer 48 of the signal sending device 21, a pair of data (proper data regarding the preset pump output and the flow rate) are retrieved from the ROM 31 in the signal sending device 21 and input through the buffer 49 and the buffer 46 to controller 11.

Through repetition of the above process, all the data are retrieved into the controller 11 and stored in the RAM 25 of the controller 11.

When operating with the working attachment 2 attached to the machine body 1 as shown in FIG. 6, the working attachment 2 is driven by depressing the pedal type operating device 19 in order to pilot-control the control valve 3 shown in FIG. 4. At that time, simultaneously with the output of pilot pressure from the pedal type operating device 19 to the control valve 3, the depression of the operating device 19 causes the pilot pressure to be detected by the pressure switches (not shown) so that signals indicating that the operating device has been operated are input to the controller 11.

As a result, the controller 11 determines that the pedal type operating device 19 has been operated and outputs signals representing the accelerator position and the pump output based on the proper data, thereby controlling the engine speed according to the accelerator position and the pump torque according to the pump output so that hydraulic fluid is automatically fed at an appropriate pressure and a flow rate to the working attachment 2 which is attached to the machine body 1.

The engine speed is automatically controlled with the corresponding proper data as the target value of the control in such a manner that the signals representing the accelerator position, which have been output from the engine driver 27 of the controller 11 are input into the accelerator actuator 7 of the engine 6 and that the position of the accelerator of the engine 6 is then controlled by the actuator 7.

The pump torque control is conducted in such a manner that the pump output signals output from the pump driver 26 of the controller 11 are input into the proportional control solenoid valves 12,13, where they are transformed into hydraulic pressures; the hydraulic pressures output from the proportional control solenoid valves 12,13 respectively control the pump regulators 8,9; and that the pump regulators 8,9 automatically control the respective preset pump output of the hydraulic pumps 4,5, with the corresponding proper data as the target values of control.

According to the control method of the invention, proper data concerning each working attachment which may be removably attached to the machine body is stored in the attachment and sent to the machine body, and the hydraulic sources which are adapted to feed working fluid from the machine body to the working attachment are controlled based on said proper data. Therefore, proper data concerning the operating conditions required by each working attachment can be easily and reliably input to the machine body without the danger of a mismatch between proper data and the selected working attachment; hydraulic sources provided at the machine body can be controlled appropriately for the working attachment currently attached to the machine body; and, therefore, the optimal hydraulic pressure, flow rate and any other conditions required by each respective working attachment are automatically provided.

According to the control device of the invention, proper data sent from the signal sending device mounted on a working attachment is received by the controller of the machine body and stored therein, and the hydraulic sources are controlled based on said proper data. Therefore, proper data concerning the operating conditions required by each working attachment can be easily and reliably input from the signal sending device to the controller without the danger of a mismatch between proper data and the selected working attachment; hydraulic sources provided at the machine body can be controlled, by means of said controller, appropriately for each working attachment; and, therefore, the optimal hydraulic pressure, flow rate and any other conditions required by each respective working attachment are automatically provided.

According to the invention as, retrieval of proper data as well as sending and receiving of signals are controlled by a central processing device disposed between the data storage device and the transmitting means of the signal sending device. Therefore, serial communication between the controller of the machine body and the signal sending device of the attachment can be conducted by using a single transmitting means. Every time the signal sending device mounted on the working attachment receives a clock pulse signal from the controller of the machine body, proper data which concerns the working attachment and is stored in the data storage device is sent by the signal sending device to the controller through a transmitting means. As there is no need of providing the signal sending device with a CPU, production costs for a signal sending device can be reduced.

What is claimed is:

1. A method for controlling operation of a working attachment removably connected to a construction machine, said method comprising storing proper data of operation conditions characteristic to the working attachment in the working attachment, transmitting from the working attachment, responsive to a command signal sent from a controller in the construction machine to said working attachment, the proper data stored in said working attachment as an input to said controller, and outputting from the controller, based on said proper data input thereto, control function signals to control construction machine hydraulic sources which feed working fluid from the construction machine to the working attachment.

2. A construction machine control device for controlling working fluid feed to a working attachment attached to the construction machine by controlling hydraulic sources carried on the construction machine, comprising a signal sending means carried on the working attachment, said signal means storing proper data of operation conditions characteristic to the working operation of the working attachment, and a controller carried on the construction machine, said controller being operable to command the signal sending means to transmit the proper data as a signal input to said controller for storage of said proper data in said controller, said controller operating to output control function signals based on said proper data to control construction machine hydraulic sources which feed working fluid from the construction machine to the working attachment.

3. A construction machine control device as claimed in claim 2, wherein the signal sending means includes a data storage device for storing proper data of operating conditions characteristic to the working operation of each of a plurality of working attachments, a central processing device for retrieving proper data from said data storage device, and a transmitting means effective to receive retrieval command signals sent from the controller to said central processing device and send to the controller proper data which have been retrieved from the data storage device by the central processing device.

4. A construction machine control device as claimed in claim 2, wherein the signal sending means includes a data storage device for storing proper data of operating conditions characteristic to the working operation of each of a plurality of working attachments, and a transmitting means effective to receive clock pulse signals from the controller of the construction machine and send proper data stored in said data storage device to the controller.

* * * * *